US009206821B2

(12) United States Patent
Post et al.

(10) Patent No.: US 9,206,821 B2
(45) Date of Patent: Dec. 8, 2015

(54) HYDRAULIC SWITCHING MECHANISM FOR MOBILE HYDRAULICS, MOBILE HYDRAULIC MACHINE AND VALVE UNIT

(75) Inventors: Karl-Heinz Post, Kaarst (DE); Michael N. Wheeler, South Point, OH (US); Richard G. Wheeler, Sr., Corpus Christi, TX (US); Robert Weber, Wadsworth, IL (US)

(73) Assignee: Caterpillar Global Mining Europe GmbH, Lünen (DE)

( * ) Notice: Subject to any disclaimer, the term of this patent is extended or adjusted under 35 U.S.C. 154(b) by 996 days.

(21) Appl. No.: 13/320,980

(22) PCT Filed: May 11, 2010 (Under 37 CFR 1.47)

(86) PCT No.: PCT/IB2010/052094

§ 371 (c)(1), (2), (4) Date: Jun. 8, 2012

(87) PCT Pub. No.: WO2010/134001

PCT Pub. Date: Nov. 25, 2010

(65) Prior Publication Data

US 2013/0042935 A1 Feb. 21, 2013

(30) Foreign Application Priority Data

May 18, 2009 (DE) ..... 10 2009 025 827

(51) Int. Cl.
*F15B 11/00* (2006.01)
*F15B 13/04* (2006.01)
(Continued)

(52) U.S. Cl.
CPC ..... *F15B 11/006* (2013.01); *F15B 13/043* (2013.01); *F15B 13/0405* (2013.01);
(Continued)

(58) Field of Classification Search
CPC ..... F15B 11/006; F15B 13/024; F15B 2211/30575
See application file for complete search history.

(56) References Cited

U.S. PATENT DOCUMENTS 5,975,134 A 11/1999 Schwelm
6,502,500 B2 * 1/2003 Yoshino ..... 91/446
(Continued)

FOREIGN PATENT DOCUMENTS

CH 660512 A5 4/1987
CL 2319-2006 9/2006
(Continued)

OTHER PUBLICATIONS

Will, Dieter and Gebhardt, Norbert; Hydraulik. ISBN 978-3-540-795346 S.220-223, Abb.8.48a.

*Primary Examiner* — F. Daniel Lopez

(57) ABSTRACT

A hydraulic switching mechanism for the mobile hydraulics of, for example, hydraulic excavators, with a valve block, with electrohydraulically activatable valve units for controlling the movement of a working cylinder whose cylinder chambers can be selectively connected to a pump connection for hydraulic fluid, to a tank connection or to one another, and with pre-control valves for activating the valve units, wherein the hydraulic switching mechanism, by means of separate tank valve units and pump valve units, and also a suitable pre-control system, makes it possible to achieve a directional control valve function and a directly controlled and superimposed pre-controlled lowering braking function, a maximum pressure safeguarding of the cylinders and a proportional throttle valve function for the controlled displacement under negative load forces in the direction of movement and braking in an emergency; and mobile hydraulic machines having such a hydraulic switching mechanism and also to valve units therefor.

22 Claims, 11 Drawing Sheets

(51) Int. Cl.
*F15B 13/042* (2006.01)
*F15B 13/043* (2006.01)

(52) U.S. Cl.
CPC ... *F15B13/0426* (2013.01); *F15B 2211/20546* (2013.01); *F15B 2211/30505* (2013.01); *F15B 2211/30575* (2013.01); *F15B 2211/7053* (2013.01); *Y10T 137/8593* (2015.04)

(56) References Cited

U.S. PATENT DOCUMENTS

| | | | | |
|---|---|---|---|---|
| 6,691,604 | B1 * | 2/2004 | Hajek et al. | 91/436 |
| 6,745,992 | B2 | 6/2004 | Yang et al. | |
| 2007/0022871 | A1 | 2/2007 | Smith et al. | |
| 2007/0056439 | A1 | 3/2007 | Vonderwell | |
| 2007/0130935 | A1 | 6/2007 | Stephenson et al. | |

FOREIGN PATENT DOCUMENTS

| | | | |
|---|---|---|---|
| CL | 2549-2011 | | 10/2011 |
| DE | 2147439 | A1 | 4/1973 |
| DE | 3619927 | A1 | 12/1987 |
| DE | 3905015 | A1 | 8/1990 |
| DE | 4214661 | A1 | 11/1993 |
| DE | 29604215 | U1 | 5/1996 |
| DE | 19649347 | A1 | 6/1998 |
| DE | 19715157 | A1 | 10/1998 |
| DE | 19728092 | A1 | 1/1999 |
| DE | 10034931 | A1 | 1/2002 |
| DE | 1338802 | A2 | 8/2003 |
| DE | 20215838 | U1 | 4/2004 |
| DE | 202004013595 | U1 | 11/2007 |
| DE | 112006002022 | T5 | 7/2008 |
| DE | 112006002399 | T5 | 7/2008 |
| EP | 1338802 | A2 | 8/2003 |
| JP | 60196476 | A | 10/1985 |

* cited by examiner

HYDRAULIC SWITCHING MECHANISM FOR MOBILE HYDRAULICS, MOBILE HYDRAULIC MACHINE AND VALVE UNIT

The invention relates to a hydraulic switching mechanism for the mobile hydraulics of mobile hydraulic machines, in particular hydraulic excavators, with a valve block, with electrohydraulically activatable valve units arranged in the valve block for controlling the movement of a working cylinder having two oppositely acting cylinder chambers which can in each case be connected via cylinder connections to the valve block, wherein the cylinder connections can be selectively connected to a pump connection for hydraulic fluid, to a tank connection or to one another, and with pre-control valves for the electrohydraulic activation of the valve units, wherein a directional control valve function for the direction of the movement, and a lowering braking function for the sequence of the movement, of the associated working cylinder can be controlled by means of the hydraulic switching mechanism. The invention also relates to mobile hydraulic machines having such a hydraulic switching mechanism and to valve units therefor.

BACKGROUND OF THE INVENTION

In the case of driveable and hence mobile working machines, the particular constraints and demands placed on the structural design of the hydraulic devices have resulted in the independent category of mobile hydraulics being developed in parallel to stationary hydraulics, and the invention relates to the technical field of mobile hydraulics. In hydraulic drives for controlling a hydraulic cylinder or hydraulic motor, the drive movement normally occurs with pressure and throughflow generated in a pump unit against the load forces acting on the cylinder from outside counter to the direction of movement (positive load forces). However, it is also possible in the course of movement for negative load forces to occur in the direction of movement—such as during lowering of lifted loads, a braking of moved masses or load direction reversal—which result in undesired leading and uncontrolled lowering of the cylinder. In addition to the uncontrolled movement, a negative pressure with cavitation would occur on the cylinder side driven by the pump throughflow, with the result that the hydraulic system may be damaged. In order to control the working cylinders in mobile hydraulic machines, use is made of 6/3-port directional control valves of piston slide valve type with a proportional throttling function which are designed specifically for use in mobile hydraulics and which, upon activation, throttle in a proportionally controlled manner both the oil inflow from the pump to the working cylinder and the oil outflow from the working cylinder to the tank. The main working movements—generally during the extension of the cylinder—occur with positive force loadings, wherein the load acts in a pushing manner counter to the desired direction of movement of the consumer. However, negative force loadings can also occur in both directions of movement, wherein the load acts in a pulling manner in the same direction as the desired direction of movement, such as, for example, during the lowering of loads, braking of large moved masses and load change of externally acting forces. As a consequence, the volumetric flow flowing from the cylinder to the tank must be throttled in order to prevent undesired acceleration and uncontrolled movement of the cylinder, and it is known to provide valves having a lowering braking function for this purpose. In mobile hydraulics, use is made of complex mobile control blocks having a plurality of 6/3-port directional control valves with all the required additional functions, including the throughflow distribution to the connected cylinders from a delivery pump.

Excavator booms and other working manipulators, such as shovels, buckets or sliding ploughs, within the sector of mobile working machines are nowadays predominantly controlled by the operator by means of hand lever pre-control devices (joysticks). When problematic operating states occur, which may be caused for example by changing loads or particularly quick or slow movements, the operator must then perform a corresponding actuating signal correction to maintain the desired setpoint movements, something which requires appropriate training and experience. With regard to boom and dipper cylinder control of a shovel excavator, there is obtained a separate function whereby, after the extension operation, the lowering during the retraction of the cylinders is intended to take place through self-weight without pump inflow. This function is referred to below as "floating". For this purpose, the piston side and rod side of the working cylinder are bypass-connected or short-circuited. The oil displaced from the piston side through the force of the weight flows, in order to replenish the oil volume sucked away, partially to the rod side and the residual quantity flows to the tank. The lowering speed is electrohydraulically proportionally controlled by a throttling bypass valve in a variable remote-controllable manner. The residual quantity flowing to the tank flows via a pre-stressing return valve which prestresses the pressure in the cylinder connection to such an extent that no cavitation can occur in the cylinder through flow losses in the cylinder line. These valves which are required for the lowering in bypass mode through self-weight must additionally be installed in the main flow with corresponding throughflow capacity between the mobile control block and cylinder. Since the mobile hydraulics used to date produce a throughflow in the part-load range via a bypass, there occur considerable hydraulic energy losses which considerably reduce the efficiency of the drive and require a large cooling capacity of the hydraulic system. This loss effect occurs particularly when braking negative load forces in the direction of movement since, in order to throttle the throughflow flowing back from the cylinder, the hitherto used valve units with valve slides have to be actuated in the closing direction always in the fine-control range with control edge undercutting. These hydraulic energy losses caused by the valve control principle come increasingly to the fore as a disadvantage as the overall size and drive power of the mobile working machine increases.

In particular in the case of large mobile machines and large-area excavators as are used, for example, in open-cast mining, given the high loads to be controlled, the required throughflow quantities and throughflow rates of far above 1000 L/min (264 gal/min), and the aforementioned disadvantages, mobile machines with a cable control are usually used.

SUMMARY OF THE INVENTION

An object of the invention is to provide a hydraulic switching mechanism for mobile hydraulics that does not have the aforementioned disadvantages, can be operated with fewer hydraulic energy losses and makes it possible to dispense with cable controls even in the case of large hydraulic machines.

These and further objects are achieved by a hydraulic switching mechanism for the mobile hydraulics of mobile hydraulic machines, in particular hydraulic excavators, with a valve block, with electrohydraulically activatable valve units arranged in the valve block for controlling the movement of a working cylinder having two oppositely acting cylinder chambers which are connectable via a cylinder connection to the valve block, wherein the cylinder connections are selectively connectable to a pump connection for hydraulic fluid, to a tank connection or to one another, and with pre-control valves for the electrohydraulic activation of the valve units, wherein a directional control valve function for the direction of the movement, and a lowering braking function for the sequence of the movement, of the associated working cylinder is controllable by way of the hydraulic switching mechanism. The mechanism further including four cone-seat valve units each having a spring-loaded valve cone in the valve block for the working cylinder, of which the first forms a pump valve unit between the first cylinder chamber connection and the pump connection, the second forms a tank valve unit between the first cylinder chamber connection and the tank connection, the third forms a pump valve unit between the second cylinder chamber connection and the pump connection, and the fourth forms a tank valve unit between the second cylinder chamber connection and the tank connection, wherein a pressure-limiting function and the lowering braking function are realizable for both directions of movement in a pressure-dependent manner as a function of the pressure in the cylinder chamber connections by way of the tank valve units via an associated pre-control valve system including a plurality of pre-control valves. Further advantageous configurations, specific solutions for the main application area of large hydraulic machines, and also valve units which can be used with advantage, are indicated in the remaining disclosure of this application.

Provision is made according to the invention for four cone-seat valve units comprising cone seat valves and each having a spring-loaded valve cone to be provided in the valve block for a working cylinder, of which the first valve unit forms a pump valve unit between the first cylinder chamber connection and the pump connection, the second valve unit forms a tank valve unit between the first cylinder chamber connection and the tank connection, the third valve unit forms a pump valve unit between the second cylinder chamber connection and the pump connection, and the fourth valve unit forms a tank valve unit between the second cylinder chamber connection and the tank connection, wherein a pressure-limiting function and the lowering braking function can be achieved for both directions of movement in a pressure-dependent manner as a function of the pressure in the cylinder chamber connections by means of the tank valve units via an associated pre-control valve system comprising a plurality of pre-control valves. In the case of the hydraulic switching mechanism according to the invention, the control block is provided with four valve units having cone seat valves optionally designed for maximum throughflow rates in order to control the working cylinders with the directional control valve functions of starting, stopping and direction of movement control and, by means of a suitable pre-control valve system, also lowering through weight loading in cylinder bypass control without additional valves, it being possible, as a function of the pre-control valve system, for the tank valve units to be given additional valve functions such as directly controlled with superimposed pre-controlled lowering braking function, maximum pressure safeguarding of the cylinders, and proportional throttle valve function for the controlled displacement under negative load forces in the direction of movement and braking during an emergency stop. Particularly for hydraulic excavators for moving large loads, it is advantageous if, in order to achieve optimum energy utilization, the speed control of the working cylinder movement occurs directly by adjusting the pump delivery flow without additional throttle valve functions. The cylinder connections can each be connected to a pump unit via the two pump valve units. The cylinder connections can each be connected to the tank via the tank valve unit. The valve cones of the tank valve units are controlled and positioned pressure-dependently via a control connection and also via the pilot and pre-control valves which are preferably integrated in a valve block.

To optimize the mobile hydraulics, it is particularly advantageous if the tank valve units make it possible, in addition to the directional control valve function for starting, stopping and direction influencing, to ensure a blocking function in the zero position, maximum pressure safeguarding of the two cylinder chambers, hence a piston side or a cylinder rod side of the working cylinder, a counterpressure function with adaptation of the counterpressure to the cylinder load force, hence a lowering braking valve function with activatable, relievable counterpressure function for both directions of movement of the working cylinder, and an electrohydraulic proportional throttle valve function for the cylinder outflow control to the tank during the braking of negative cylinder load forces and moved masses independently of the delivery flow control of the pumps. It is further advantageous if the proportional throttle valve function can also be used in addition to controlling the lowering operation for the cylinder retraction through cylinder load force (weight force) without pump inflow, i.e. a so-called "floating", something which can be achieved, in particular, if, according to a particularly advantageous configuration according to the invention, the proportional throttle valve function is integrated via the pre-control valve system into both tank valve units. The combining of a plurality of valve functions in a valve unit correspondingly requires a pre-control circuit, composed of a plurality of pilot or pre-control valves, in a pre-control valve system, and the text which follows reveals numerous advantageous configurations and variants of valve units and pre-control valve systems for achieving the plurality of valve functions in combination with a compact and operationally reliable construction of the hydraulic switching mechanism.

According to an advantageous configuration, the valve cones of the tank valve units can have a seat surface which is directly pressurized with the pressure in the associated cylinder connection, and a control surface which is indirectly pressurized with the same pressure through the interposition of a pressure-limiting valve in the pre-control valve system. The switching position of the valve cone is dependent on the control pressure exerted on the control surface in relation to the pressure forces which are active on the seat surfaces via the hydraulic pressure in the cylinder chamber connections. When the control pressure is relieved, the valve cone opens and throughflow can occur in both directions; when the control pressure is applied, the valve cone closes and blocks the throughflow in a leakage oil-free manner. Further preferably, a nozzle can be arranged in a control line between the cylinder connection and the pressure-limiting valve, and/or a nozzle can be arranged in a control line between the pressure-limiting valve and a control chamber for pressurizing the control surface. The tank valve units can then form pressure-limiting valves which are pre-controlled in their output function, it being possible by switching a pre-control valve in the pilot valve system to achieve additional pressure relief.

In order to increase the opening pressure of the valve cone to blocking pressures of, for example, 60 (870 psi) bar to 100 bar (1450 psi), as may occur in particular when using the hydraulic switching mechanisms according to the invention in the mobile hydraulics of heavy-load excavators, in addition to a valve spring, the valve cone of the tank valve unit can be subjected to the spring force of a disc spring stack in the direction of the valve seat. According to a particularly advantageous configuration, the valve cone is designed as a hollow socket with a cavity situated opposite the seat surface, wherein the valve spring and a plunger each bear against the valve cone by one end at the bottom of the cavity, and the other end of the plunger is subjected to the spring force of the disc spring stack. The installation into the tank valve units of a disc spring column guided by a plunger means that it is possible, via the plunger, to transmit additional high closing forces to the valve cone, and an additional directly controlled pressure limiting can be produced. Consequently, and as a result of the friction between the series-arranged disc springs, there is an improvement in the stability in the regulating response in the case of the installed pre-controlled pressure functions. The directly acting closing function of the disc spring stack on the valve cone affords an additional safety function, which means that even in the event of a failure of the pre-control system—for example in the event of clogging of the inlet nozzle to the pressure-limiting valve and resulting lack of pressure build-up on the valve cone control surface, this directly acting counterpressure of the disc spring force remains for braking purposes.

It is particularly advantageous if, in the case of the tank valve units, a lifting piston sleeve with a lifting piston is arranged between the disc spring stack and the valve cone, wherein that surface of the lifting piston which is situated facing away from the disc spring stack forms a lifting piston control side and can be subjected to or is subjected to the hydraulic pressure of the respective other cylinder chamber connection via a control line. Preferably, the lifting piston is guided displaceably on the plunger and is moveable relative to the plunger in the axial direction. This lifting piston function is mechanically kinematically uncoupled from the valve cone/plunger movement and acts only on the column of the disc spring stack, with the result that closing and pressing functions with the valve cone which are controlled by the valve pre-control system are possible in parallel and at the same time. There results the function of a directly controlled lowering braking valve with an activatable counterpressure function.

In order to achieve an extended lowering braking function even for higher load-holding pressures of up to about 350 bar (5,076 psi), according to an alternative embodiment, there can be arranged in the valve pre-control system a directly controlled pilot lowering braking valve with a valve cone slide which has an opening pressure surface which is subjected, via a preferably electrically activatable pilot valve, to the pressure of the control line connected to the associated cylinder chamber connection, and which has a pressure activation surface which is subjected, via a pressure return line, to the pressure in the other cylinder chamber in order to bring about an additional pressure relief at the control pressure surface of the valve cone. Upon actuation of a pilot valve, this directly controlled lowering braking valve with an activatable counterpressure function as a pre-control valve for controlling the pressure of the valve cone of the tank valve unit is switched on. The tank valve unit then operates in the basic function as a hydraulically pre-controlled lowering braking valve. The pre-control valve can be set to the maximum load-holding pressure of the respective application with an additional safety of 20-30% so that this cylinder load is securely blocked against undesired lowering. Through the pressure return, the pilot lowering braking valve opens at substantially lower pressures than the set maximum load-holding pressure and, at the pressure control surface of the valve cone, generates a lower control pressure which, together with the directly controlled lowering braking function with valve cone and disc spring stack, produces a resulting braking counterpressure on, for example, the cylinder piston side. Even under a changing negative load force, this braking counterpressure still remains precisely high enough for a low drive pressure to be permanently established on the rod side of the working cylinder. The directly controlled lowering braking function with valve cone, plunger, lifting piston and disc spring stack is always active when there is a low drive pressure on the rod side (or the piston side). The pre-controlled lowering braking function is only activated when there is a high drive pressure on the rod side in order, under a simultaneously negative load force, to produce the required counterpressure for a controlled lowering via the control pressure on the valve cone. With a load change and a positive load force F against the direction of movement, it is possible as a result of the required high driving pump pressure on the cylinder rod side for the disc spring stack to be raised by the lifting piston as far as a lifting piston stop such that this stack no longer acts on the valve cone. At the same time, the pilot lowering braking valve can be completely activated and the control pressure on the valve cone can be completely removed to the tank such that the valve cone opens against the valve spring as a non-return valve, with the result that a counterpressure braking the retraction movement is avoided on the piston side. In the event of a sudden stop in an emergency situation, it is also possible, independently of the lifting piston/disc spring stack assembly, for the valve cone to be displaced into the closed position by relieving the pilot directional control valve. The influence of the pre-controlled lowering braking valve function can be varied through the use of interchangeable pilot lowering braking valves with different transmission ratios by means of stepped pressure activation surfaces and thus adapted to the different conditions of the overall control. Further adaptation of the effect of this pre-controlled lowering braking valve function is possible via the size of a nozzle preferably connected upstream of the pilot lowering braking valves. The directly controlled lowering braking function with valve cone and disc spring stack and lifting piston for counterpressure control leads to a significantly improved stability behaviour.

In order to be able in a simple manner to modify the transmission ratio for the direct lowering braking function in order to reduce the drive pressure, it is advantageous if the lifting piston is installed in an interchangeable insert which can be interchanged as a structural unit in a completely functional manner after disassembly of a valve block cover and, if appropriate, can be replaced by lifting pistons having different hydraulic active surfaces.

According to a further advantageous configuration, a proportional throttle valve function is possible with the hydraulic switching mechanism. The additional proportional throttling function can be controlled in particular via the tank valve units and the pre-control system for regulating the hydraulic oil flow from the cylinder to the tank connection. The proportional throttling function ensures that a "floating", i.e. a control of the lowering movement through self-weight without pump inflow for the cylinder retraction, is possible, a limiting of the maximum cylinder speed is ensured in the case of delayed response of the lowering braking valve function and/or in the case of extreme cylinder load conditions, and furthermore a proportionally controlled outflow throttling function is made possible during load cycles with stability problems occurring during the lowering braking function. In a normal case, the lowering movement of the cylinders should here take place through the weight force acting on the cylinder as a negative load force in the direction of movement. By activating further pilot directional control valves, the two pump valve units C1 and C3 can be opened and the cylinder chambers of the working cylinder, hence the piston side and rod side of the working cylinder, can be hydraulically connected. If at the same time a tank valve unit is opened in a throttled manner, a portion of the throughflow displaced from the piston surface flows, corresponding to the surface ratio of the cylinder, via the pump valve unit arranged in series for this purpose in order to replenish the oil volume sucked away from the cylinder rod side ZB. The remaining residual flow displaced as surplus flows away in a throttled manner to the tank, with the lowering speed of the cylinder being determined by setting the throttling opening cross section. A return flow to the pump is preferably prevented by a non-return valve in the pump inlet. Since the weight force acts directly on the piston rod surface after the short-circuit connection of the cylinder connections, owing to the resulting higher pressure through pressurization of the lifting piston via the control line Z2, this lifting piston will raise the disc spring stack and completely cancel or at least to a large degree compensate for the closing force on the valve cone.

The opening stroke of the valve cone of the tank valve units, which stroke is proportional to a predetermined electrical signal, can be produced by means of different electrohydraulic positioning systems. For the preferred application area of hydraulic excavators which are exposed to harsh environmental influences, simple, robust systems without electronics installed on the valve are preferred for internal return lines. According to an advantageous variant embodiment, it is possible, in particular to set the throttling opening cross section, for the tank valve units each to be assigned an adjusting piston system with internal position regulation through force balancing. The actuating piston system is preferably arranged in a portion adjoining the installation chamber for the disc spring stack and comprises a pressurized actuating piston which bears against the plunger with pre-stressing in the closing direction of the valve cone. The actuating piston preferably has a pressure surface which is larger, preferably about 1.1 to 2.2 times larger, than the seat surface of the valve piston of the assigned tank valve unit. The pressurization of the actuating piston is preferably adjustable by means of a proportional magnet, a control piston and a return spring and/or the actuating piston system is assigned a control valve with alternate pump connection or tank connection coupling. The proportional throttling function can then become operative in a superimposed manner with respect to the opening stroke limiting during the lowering braking function and separately also as outflow throttling during cylinder lowering through self-weight (floating), wherein the closing force of the disc spring stack is reduced or cancelled corresponding to the cylinder pressure which is established after the connection of the two cylinder sides. By virtue of the force-locking connection of the valve cone via the plunger against the actuating piston with an enlarged active pressure surface, there results a differential piston assembly which can be positioned by pressure control on the actuating piston surface acting in the closing direction via a three-way control valve having alternate pressure or tank connection. The positioning is carried out in the closed position control loop by force balancing at the control piston between the actuating force of the proportional magnet as a set point value and the spring force, produced by the actuating piston proportionally to the opening stroke, of a return spring as actual value. Alternatively, in order to control the throttling opening cross section, the tank valve units can each be assigned an electric stepping motor, in particular a linear motor, and a following piston system comprising a control piston and following piston. The positioning of the opening stroke by the proportional throttle valve can continuously occur analogously through adjustment of the control valve by the proportional magnet or the electrical linear motor during the lowering movement. However, the stroke opening position can also be set as a fixed set point value at the proportional magnet or the electrical linear motor before the lowering movement. Upon actuation of an assigned pilot directional control valve, the adjusting piston or following piston, coupled with the valve cone, runs into this predetermined position.

The pilot control valves and pilot directional control valves of the pre-control valve system and/or the overall pilot control circuit are preferably arranged in a valve housing cover which can be releasably connected to the valve block.

The main application area of the invention concerns hydraulic machines, in particular large hydraulic excavators having flow rates far in excess of 1000 L/min (264 gal/min), with at least one hydraulic cylinder as working cylinder for adjusting at least one arm connected to a working implement such as a bucket, shovel or the like, with a pump unit for generating a hydraulic oil flow, with a hydraulic switching mechanism comprising a valve block as mobile hydraulics for the hydraulic machine, with electrohydraulically activatable valve units arranged in the valve block for controlling the movement of the working cylinders, and with pre-control valves in the hydraulic switching mechanism for the electrohydraulic activation of the valve units, wherein a directional control valve function for the direction of the movement, and a lowering braking function for the sequence of movement, of the associated working cylinder can be controlled by means of the hydraulic switching mechanism, wherein a hydraulic switching mechanism designed according to the invention, as described above, is used in these hydraulic machines. It is then particularly advantageous if, in particular to achieve optimum energy utilization in all load ranges with particular consideration to part load, the speed control of the working cylinder is performed only via the pump delivery flow without additional control valve throttling losses. For this purpose, when use is made of diesel engines as the drive unit, the pump delivery quantity can be produced with variable displacement pumps and, by electrohydraulic adjustment of the pivoting angle, the delivery flow and hence the speed of the working cylinders can be controlled. Additional throttle valves in the cylinder inflow with energy losses for controlling the delivery flow regulator of the variable displacement pump are then no longer required. When use is made of electrical three-phase motors as the drive unit, the pump delivery flow can be produced with fixed displacement pumps and be regulated by rotational speed regulation with frequency converters.

The invention also relates to the valve unit for the above-described hydraulic switching mechanism for mobile hydraulic machines, in particular tank valve units which are designed as a cone-seat valve of cartridge construction which can be inserted into a bore in the valve block and which comprises a valve sleeve, valve cone and valve spring, wherein the valve cone is designed as a hollow socket with a cavity situated opposite to a seat surface as a bearing surface for the valve spring and for a plunger which is subjected to or can be subjected to the spring force of a disc spring stack. It is particularly advantageous if the disc spring stack and the plunger are arranged together with a lifting piston in a lifting piston sleeve, wherein the lifting piston is guided displaceably on the plunger and is moveable relative to the plunger in the axial direction of the mounting bore in the valve block, and that side of the lifting piston which is situated facing away from the disc spring stack forms a lifting piston control side. The lifting piston sleeve together with the associated functional parts can be advantageously arranged in the valve block cover so that, by exchanging the lifting piston sleeve for a lifting piston sleeve having different active surfaces and/or by exchanging the cartridge valves for a cartridge valve having a different valve nominal size, optimum adaptation to the required throughflow capacities and pressure conditions can be achieved.

Further advantages and configurations of a hydraulic switching mechanism according to the invention, particularly for use in large hydraulic machines, will become apparent from the description given below of schematic figures for the construction of the switching mechanism together with the associated pilot valve control circuit.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
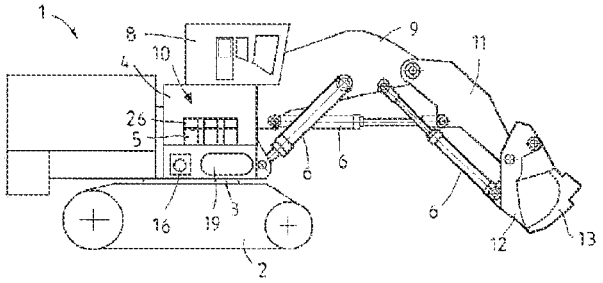
FIG. 1 schematically shows a hydraulic excavator with a hydraulic switching mechanism according to the invention.

Referring now to the drawings wherein the showings are for the purpose of illustrating preferred and alternative embodiments of the invention only and not for the purpose of limiting same, FIG. 1 shows a hydraulic excavator 1 in a design known per se with an undercarriage 2 and turntable 3 which are used to rotatably support a working platform with a machine housing 4, a driver's cab 8 and also boom 9, dipper 11 and in this case a bucket 12 as working implement. The bucket is assigned a hydraulically pivotable bucket flap 13 which may, if appropriate, be fitted with tools for loosening the soil. The boom 9, dipper 11 and bucket 12 are connected to one another via pivot joints and can be electrohydraulically adjusted independently of one another via a joystick (15, FIG. 2) in addition to an associated electrical pilot controller (17, FIG. 2) and separate working cylinders 6 for the boom 9, dipper 11 and bucket 12. The excavator 1 is preferably a large excavator for extracting materials in open-cast mining, for example, and all the working movements of the working implement are here preferably carried out exclusively hydraulically via the hydraulically retractable and extendable working cylinders 6, for which purpose there is arranged in the machine housing 4 a hydraulic switching mechanism 10 with a respective valve block 5 and valve block cover 26, via which block and cover the hydraulic fluid flow between a pump 16, the cylinder chambers of the working cylinders 6 and a tank 19 can be controlled and regulated.

To achieve optimum energy utilization in all load ranges with particular consideration to the part load, the speed of the operating cylinders 6 in a hydraulic excavator 1 designed according to the invention is controlled only via the pump delivery flow of the pump 16 without additional control valve throttling losses. When a diesel engine is used as the drive unit for the hydraulic excavator 1, the pump delivery quantity is generated with variable displacement pumps, with the delivery flow and hence the speed of the working cylinders being controlled by electrohydraulic adjustment of the pivoting angle. Additional throttle valves in the cylinder inflow with energy losses for controlling the delivery flow regulator of the variable displacement pump are then no longer necessary. When electrical three-phase motors are used as the drive unit, the pump delivery flow can be generated with fixed displacement pumps and be regulated by rotational speed regulation with frequency converters.

Figure 2:
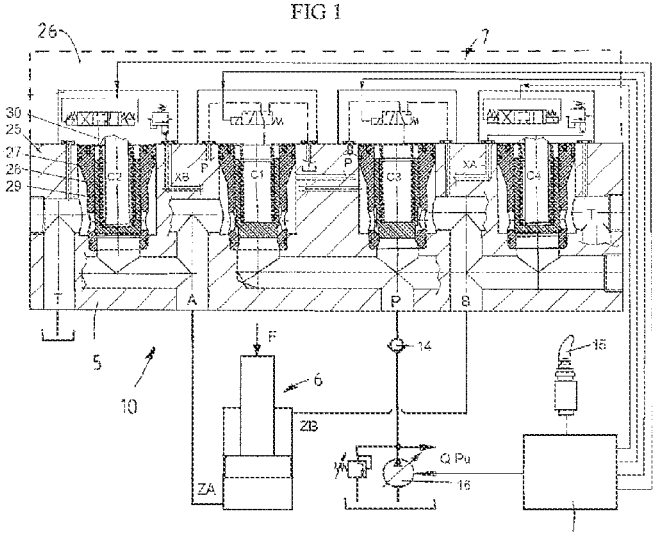
FIG. 2 schematically shows, by way of a combination of a hydraulic block diagram and sectional view through a valve block, the construction of a hydraulic switching mechanism according to the invention with two tank valve units and two pump valve units.

FIG. 2 shows the basic construction of a valve block 5 of a hydraulic switching mechanism 10 according to the invention for controlling all the functions of an associated hydraulic working cylinder 6. To control a working cylinder 6, for each cylinder chamber ZA or ZB, with the cylinder chamber ZA designating the piston chamber and ZB the piston rod chamber in the exemplary embodiment shown, use is made in each case of two valve units C1, C2, C3, C4 in the form of installation valves installed in mounting bores 7 in the valve block 5, of which two form the tank valve units C2, C4, which as a function of the switching state connect the associated cylinder chamber ZA or ZB, connected to the valve block via the cylinder connections A and B, to the tank connection T, and of which two form the pump valve units C1, C3 which can connect the cylinder connections A, B to the pump connection P in the valve block 5. To control a cylinder 6, according to the exemplary embodiment according to the invention exactly four valve units C1-C4 are required which all comprise cone-seat valves of cartridge construction and each have a valve cone 28 which in the closed state is pressed in a sealing and closing manner by a valve spring 29 against a valve seat on a valve sleeve 27. With the four valve units, it is possible by means of a pre-control or pilot valve system of suitable construction of a pre-control circuit, which system is designated in a overlapping manner in the figures by reference sign 7, to achieve all the desired valve functions for cylinder control, wherein all the pre-control valves are integrated in a valve block cover 26 which can be releasably connected to the valve block 5 for the working cylinder 6. In the case of a hydraulic switching mechanism 10 for a hydraulic excavator, account has to be taken of the particular relationships of the cylinder controls for the functions of, for example, boom, dipper, bucket and flap actuation of a shovel excavator. It is intended for the working cylinder for the boom and dipper during the return stroke to be lowered through self-weight without pump inflow in bypass mode (floating), wherein, according to the solution according to the invention, the use of the additional throttling bypass valves and prestressing non-return valves required for this purpose in the prior art is dispensed with.

Via the two pump valve units C1, C3, the cylinder chambers ZA and ZB can be respectively connected to the pump unit 16 or to the pump connection P via the associated cylinder connections A, B in the valve block 5. Via the two tank valve units C2, C4, the cylinder chambers ZA and ZB can be respectively connected to the tank via the tank connection T. As has been shown specifically for the tank valve units C2, C4 in FIGS. 4 to 7, these units are controlled and positioned in a pressure-dependent manner via the control connection 30 in the valve block cover 26 and the pilot valves integrated therein, as will be explained later. The switching position of the valve cone 28 is dependent on the control pressure exerted on the control surface 31 in relation to the pressure forces which are active on the working or seat surfaces 33 in the main flow working connections or cylinder connections A, B. When control pressure is relieved, the valve cone 28 opens and throughflow can take place in both directions, and when control pressure is applied, the valve cone 28 closes and blocks the throughflow in a leakage oil-free manner.

The cylinder 6 is extended during operation with a signal preset at the hand lever (joystick) 15 by proportional delivery flow setting at the pump unit 16 for setting the speed and simultaneous actuation of the directional control valve function by opening of pump valve units C1 and tank valve units C4 during activation by the electrical pilot controller 17 of the pilot directional control valves arranged in the valve block cover or covers 26, with the result that the control surfaces 31 in the control oil chamber 32 are pressurelessly relieved and the valve cones 28 open while being pressurized by the main flow connections. The working cylinder 6 is retracted with pump inflow by activating and opening pump valve unit C3 and tank valve unit C2.

For the floating function for lowering the working cylinder 6 through self-weight without pump inflow, the two pump valve units C1, C3 are opened for bypass-connection of the cylinder connections ZA with ZB. By opening the tank valve unit C4 equipped with an additional proportional throttling function for controlling the lowering speed, the excessively displaced residual oil quantity flows to the tank.

All of the directional control valve functions required for the cylinder control are carried out by the four cone-seat valve units C1, C2, C3 and C4 arranged in the mobile valve block 5. Each of these cartridge valves can be optimally adapted to the required throughflow arrangements by selecting the valve nominal size, for which reason a parallel connection of valves to achieve the throughflow capacity, as previously employed in the prior art, is dispensed with.

Figure 3:
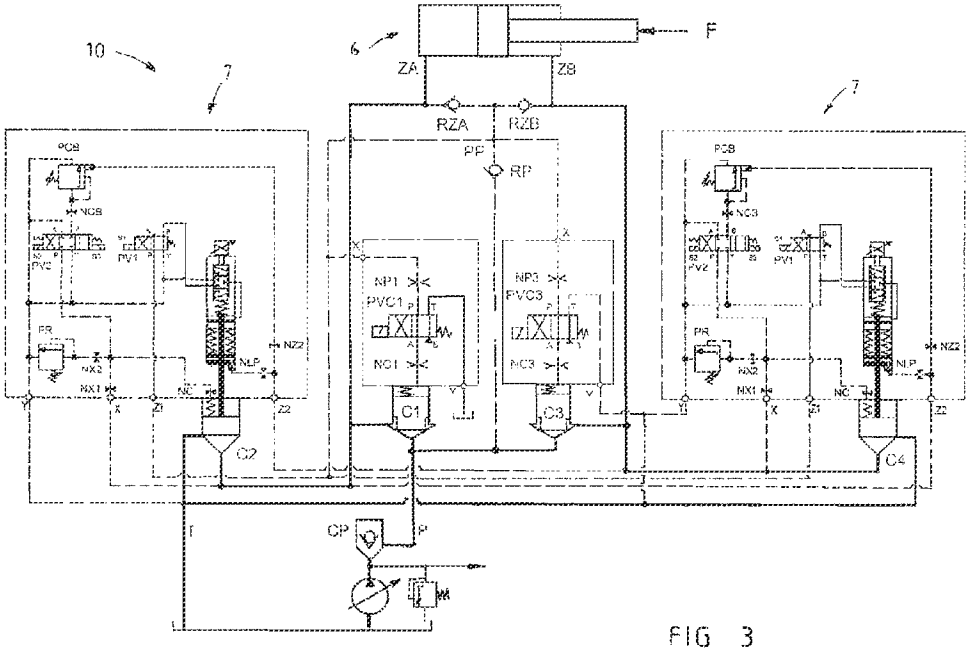
FIG. 3 schematically shows the hydraulic circuit in a hydraulic switching mechanism according to the invention for both directions of movement of a working cylinder.

The valve block covers 26 contain all the pilot valves required to control the respective valve unit C1, C2, C3 and C4 in order to relieve the mobile valve block 5 of control bores. FIG. 3 shows the hydraulic circuit of the control valves PVC1, PVC2, PV1, PV2, PCB, PR arranged in the mobile valve block 5 according to FIG. 2 and in the valve block covers 26, in addition to control lines or return lines XA, XB, Z1, Z2, non-return valves RZA, RZB and nozzles NC, NLP, NX1, NX2, in order, via the hydraulic circuit implemented with the hydraulic switching mechanism 10, to provide a cylinder control with all the valve functions including lowering braking valve with integrated throttling function in the tank valve units C2, C4 for both directions of movement of the cylinder 6, i.e. pressurization of the cylinder chamber ZA on the cylinder piston side and of the cylinder chamber ZB on the cylinder rod side.

In addition to the directional control valve function for starting, stopping and direction influencing, the tank valve units C2, C4 contain the following valve functions via the construction of the pilot control system 7:

- blocking function in neutral position
- maximum pressure safeguarding of the cylinder piston side or the cylinder rod side
- counterpressure function with adaptation of the counterpressure to the cylinder load force, that is to say lowering braking valve function with activatable, relievable counterpressure function for both directions of movement of the working cylinder 6
- electrohydraulic or proportional throttle valve function with multiple benefits for the cylinder outflow control to the tank during the braking of negative cylinder load forces and of moved masses independently of the delivery flow control of the pumps 16 on the one hand and for controlling the lowering operation for the cylinder return stroke through cylinder load force (weight force) without pump inflow (floating) on the other hand. For versatile utilization and adaptation, the proportional throttle valve function is in practice integrated into both tank valve units C2, C4.

The construction of the tank valve units and of the pilot valve system for implementing the aforementioned valve function will now be explained with reference to the further figures. The combining of a plurality of valve functions is achieved by means of a pre-control circuit 7 for the tank valve units C2, C4 which is composed of a plurality of pilot valves and which is integrated substantially completely into the valve block cover 26. The fundamental overall construction of the tank valve units C2, C4 can be seen from FIG. 4. The individual functions are explained for the tank valve unit C2 for the return stroke of the working cylinder under different load conditions. The function of the tank valve unit C4 during the extension of the operating cylinder is corresponding.

Figure 4:
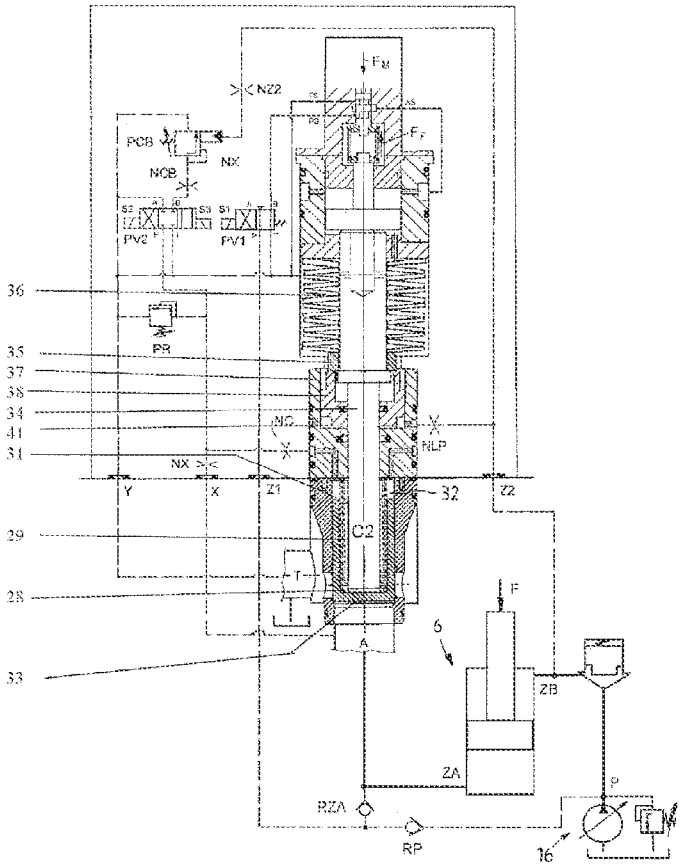
FIG. 4 schematically shows, by way of a combination of a hydraulic block diagram and a sectional view, the basic construction of a tank valve unit according to the invention.

In the basic position according to FIG. 4, with the pilot directional control valves PV1, PV2 not actuated, the valve cone 28 having a surface ratio of control surface 31/seat surface 33=1:1 is held in the closed position by the pressure fed via connection XA back to the control surface 31, supported by the closing force of the valve spring 29. The tank valve unit C2 (or C4) is in its basic output function a pre-controlled pressure-limiting valve with additional pressure relief upon actuation of magnet S3 of the pilot directional control valve PV2. In the rest position, with the pilot directional control valves PV1 and PV2 not actuated, the valve C2 (or C4) operates as a pre-controlled pressure-limiting valve which limits the maximum pressure in the cylinder connection A (or B in the case of C4) or cylinder chamber ZA (or ZB in the case of C4) to that at the pressure-limiting pilot valve PR (pressure relief). The pressure from the cylinder chamber ZA (or ZB) passes via cover connection X and via the nozzle NX to the pressure-limiting pilot valve PR and from there further via the nozzle NC to the control surface 31 or into the control oil chamber 32. When the control pressure set at pressure valve PR is exceeded, it remains constant and, with a further pressure rise in ZA, the valve cone 28 opens with a pressure which is higher by the closing force of the valve spring 29 (of in this case for example 4 bar (58 psi)) and limits it to this value. The nozzle ZX limits the pilot oil flow at the pilot pressure valve PR and the nozzle NC to the control oil chamber 32 of the valve cone 28 serves for damping and avoids pressure oscillations at the valve.

In order with the tank valve units C2 and C4 to ensure a maximum pressure safeguarding, a lowering braking valve function and a superimposed electrohydraulically actuated throttle valve function, the tank valve units, as shown in FIG. 4, are provided with a plunger 34 which is supported on the valve cone 28 and which, via a collar and the spring retainer 35, transmits to the valve cone 28 the high spring force, additionally acting in the closing direction, of a disc spring stack formed by series-connected disc springs. This measure increases the opening pressure of the valve cone 28 of previously 4 bar (58 psi) through the valve spring 29 to about 60-100 bar (870-1450 psi) when the control surface 31 is relieved of pressure. Up to this opening pressure, the valve cone 28 operates as a directly controlled pressure-limiting valve with high stability and low oscillation tendency. With a predetermined maximum pressure for securing the cylinder 6, the pressure-limiting pilot valve PR must be set lower by this opening pressure of the disc spring stack 36. To achieve a directly controlled lowering braking function with the valve cone 28 and disc spring stack 36, as is shown in construction terms according to FIG. 4 and in detailed form in FIG. 5, a lifting piston 38, fitted into a lifting piston sleeve 37, is arranged in the valve block cover 26, directly above the cartridge valve unit or the valve cone 28. The lifting piston 38 is displaceably guided on the plunger 34 and sealed via GLYD RING seals in relation to the adjacent hydraulic pressure chambers constituted by the control oil chamber 32 and disc spring installation chamber 43. When pressure is applied to the control surface 41 of the lifting piston 38, this piston acts with its pressure force against the spring retainer 35 and compensates for the closing force of the disc spring stack 36 which acts on the valve cone 28, or rather raises the disc springs as far as the lifting piston stop 42 to such an extent that the force acting on the valve cone 28 is eliminated.

Figure 6:
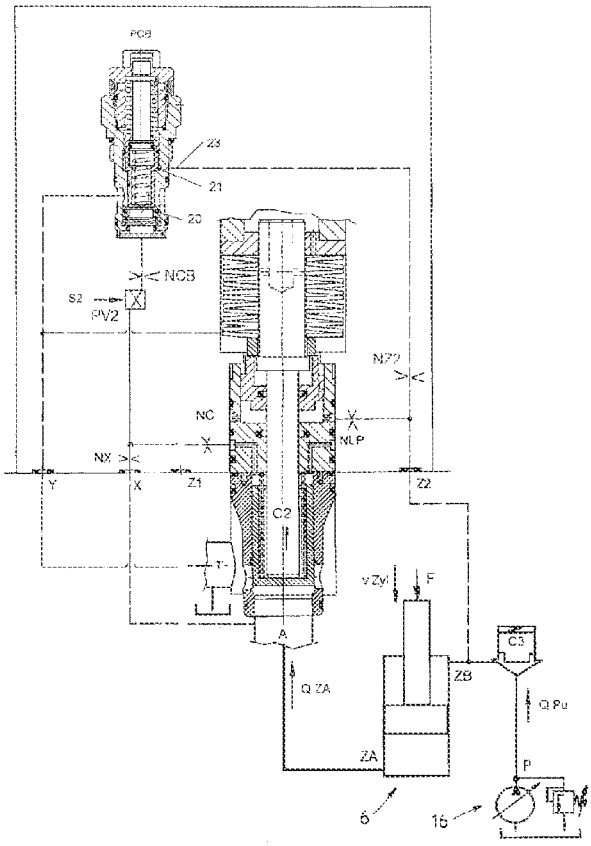
FIG. 6 shows the tank valve unit according to FIG. 2 with an extended lowering braking function for higher load-holding pressures up to 350 bar (5076 psi) with an additional pilot lowering braking valve in a lowering braking function.

A description will now be given first, with additional reference to FIGS. 6 and 7, of the directly controlled lowering braking function for the return stroke of the cylinder and pump inflow in the cylinder chamber ZB on the rod side of the cylinder 6. The return stroke under negative cylinder load is activated by actuating a pilot valve PV2 via a magnet S2. The cylinder 6 is prevented from leading as a result of the counterpressure of the disc spring forces acting on the valve cone 28, and a correspondingly high drive pressure is consequently built up in the cylinder chamber ZB and in the connection B in the valve block 5. When the pressure pZB from the cylinder chamber ZB is applied via the control connection Z2 to the lifting piston 38 via lateral bores in the lifting piston sleeve 37 and bores in the valve block cover 26, the counterpressure generated by the disc springs is partially compensated for and the drive pressure in the cylinder chamber ZB, hence on the rod side of the cylinder 6, is substantially reduced. There results the function of a directly controlled lowering braking valve with activatable counterpressure function. The seat surface 33 of the valve cone 28 here forms the opening pressure surface, the lifting piston control surface 41 according to FIG. 4 forms the pressure activation surface, and the disc spring stack 36 forms the closing spring of a directly controlled lowering braking valve. However, the lifting piston movement of the lifting piston 38 is mechanically independent of the valve cone 28. Thus, with the lifting piston 38 activated through high pressure pZB on the cylinder rod side in the cylinder chamber ZB with relieving of the pilot directional control valves PV2 to brake the cylinder 6, the valve cone 28 can switch into the blocking position independently of the lifting piston movement and stop the cylinder movement against lowering with simultaneous maximum pressure safeguarding. To achieve stable regulating functions, the nozzle NLP arranged between the control connection Z2 and lifting piston 38 is embodied for damping with a small diameter, thereby also resulting in correspondingly longer closing times for the lifting piston 38. By virtue of the uncoupled movement and control of the valve cone 28, rapid stopping in emergency situations is nevertheless achieved.

This directly controlled lowering braking function with the valve cone and disc spring stack can, given the overall size of the spring, only be meaningfully carried out up to maximum blocking pressures of about 60-100 bar (870-1450 psi). Therefore, this directly controlled lowering braking function is extended and supplemented for higher load-holding pressures up to 350 (5076 psi) bar in that an additional lowering braking function with a pilot lowering braking valve of smaller overall size is integrated into the hydraulic pre-control circuit 7. The simplified scheme of this cartridge embodiment composed of directly and additionally pre-controlled lowering braking function is represented in FIG. 6 in an open mode of operation, with all the elements which are not involved being omitted. Upon activation of pilot valve PV2 via magnet S2 according to FIG. 4 or FIG. 6, this directly controlled lowering braking valve PCB (Pilot Counter Balance) with activatable counterpressure function as pre-control valve is switched on to control the pressure of the valve cone 28. By means of the pre-control lowering braking valve PCB, the tank valve unit C2 (or C4) now operates in its basic function as a hydraulically pre-controlled lowering braking valve. The pre-control valve PCB is set to the maximum load-holding pressure of the respective application with an additional safety of 20-30% in order to block this cylinder load securely against undesired lowering.

The driving pump pressure in the cylinder chamber ZB on the cylinder rod side that is required for retracting the cylinder despite negative force action in the retraction direction is applied, through the pressure return via the connection Z2, nozzle NZ2 and activation connection 23 which are arranged or formed in the valve block cover 26, to the additional pressure activation surface 21 of the pilot lowering braking valve PCB. This valve opens at considerably lower pressures than the set maximum load-holding pressure and generates, in the control oil chamber 32 of the valve cone 28, a lower control pressure which, together with the directly controlled lowering braking function with the valve cone 28 and disc spring stack 36, brings about a resulting braking counterpressure pZA in the cylinder chamber ZA on the cylinder piston side. Even with a changing negative load force F, this braking counterpressure pZA is precisely still high enough for a low drive pressure pZB to be established in the cylinder chamber ZB on the rod side of the cylinder 6. The directly controlled lowering braking function with valve cone 28, plunger 34, lifting piston 38 and disc spring stack 36 is always active when there is a low drive pressure pZB in the cylinder chamber ZB on the rod side. The pre-controlled lowering braking function is only activated when there is a high drive pressure pZB in the cylinder chamber ZB on the rod side in order, with a simultaneously negative load force, to generate the required counterpressure in the cylinder chamber ZA for controlled lowering via the control pressure for the valve cone 28. The lifting piston 28 has then completely relieved the disc spring stack 36, as shown in FIG. 7, and the directly controlled lowering braking function is inactive.

Figure 7:
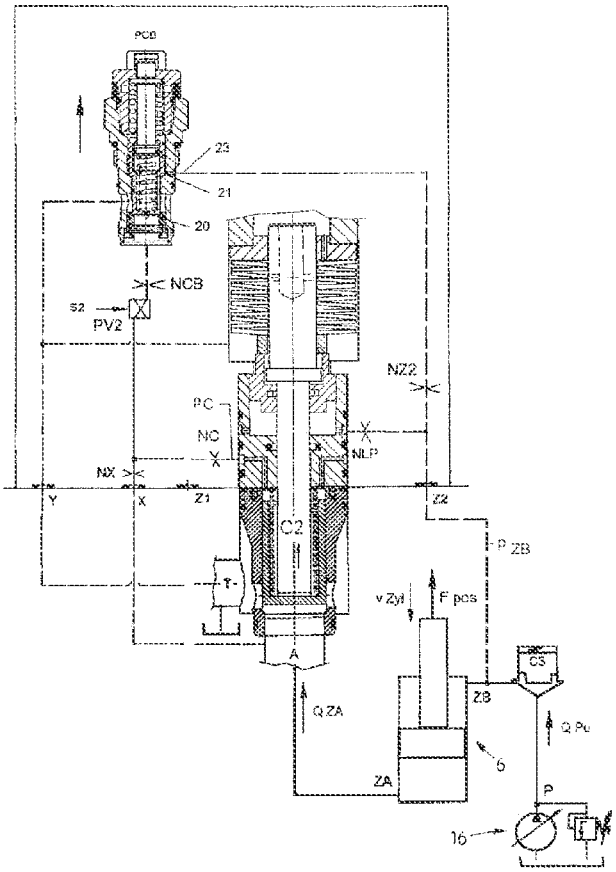
FIG. 7 shows the tank valve unit according to FIG. 5 with a positive load force and with completely uncoupled disc springs.

With a load change and a positive load force F against the direction of movement, as shown in FIG. 7, as a result of the required high driving pump pressure pZB in the cylinder chamber ZB on the cylinder rod side, the disc spring stack 36 is now raised by the lifting piston 38 as far as the lifting piston stop 42 and no longer acts on the valve cone 28. At the same time, the pilot lowering braking valve PCB is completely activated and the control pressure pC in the control oil chamber 32 of the valve cone 28 is completely removed to the tank or tank connection T. The valve cone 28 opens against the valve spring 29 like a non-return valve, with the result that no braking counterpressure on the piston side prevents the retraction movement. During a sudden stop in an emergency situation, the valve cone 28 can be displaced into the closed position independently of the lifting piston/disc spring stack assembly by relieving pilot directional control valve PV2. The influence of the pre-controlled lowering braking valve function can be varied by the use of interchangeable pilot lowering braking valves PCB having different transmission ratios by means of stepped pressure activation surfaces and can thus be adapted to the different conditions of the overall control. A further adaptation of the effect of this pre-controlled lowering braking valve function is possible via the size of the nozzle NCB connected upstream of the pilot lowering braking valves PCB. The directly controlled lowering braking function with the valve cone 28 and disc spring stack 36 and lifting piston 38 for counterpressure control leads to a significantly improved stability behaviour by comparison with a version in which only a pilot lowering braking valve PCB is used to precontrol a cartridge valve as lowering braking valve. The lifting piston 38 fitted according to FIG. 5 into the lifting piston sleeve 37, together with the two O-ring seals 39, 40 for the plunger 34 and for the lifting piston 38 and also the O-ring/supporting ring seals for the lifting piston sleeve 37, result in a functional interchangeable insert. It is thus possible, after removing the valve block cover 26, for use to be made of lifting piston inserts having different hydraulic lifting piston control surfaces 41 so as to alter the transmission ratio for the direct lowering braking function for optimum adaptation in the case of different load force conditions in order to reduce the drive pressure.

The lifting piston function also serves for compensating for or cancelling the disc spring closing force for the electrohydraulic proportional throttle valve function. The additional proportional throttling function at the tank valve units C2, C4 from the cylinder 6 to the tank return T allows a control of the lowering movement through self-weight without pump inflow for the cylinder retraction (floating), a limiting of the maximum cylinder speed with a delayed response of the lowering braking valve function and/or in extreme cylinder load conditions and forms the precondition for a proportionally controlled outflow throttling function during load cycles with stability problems occurring during the lowering braking function.

Figure 8:
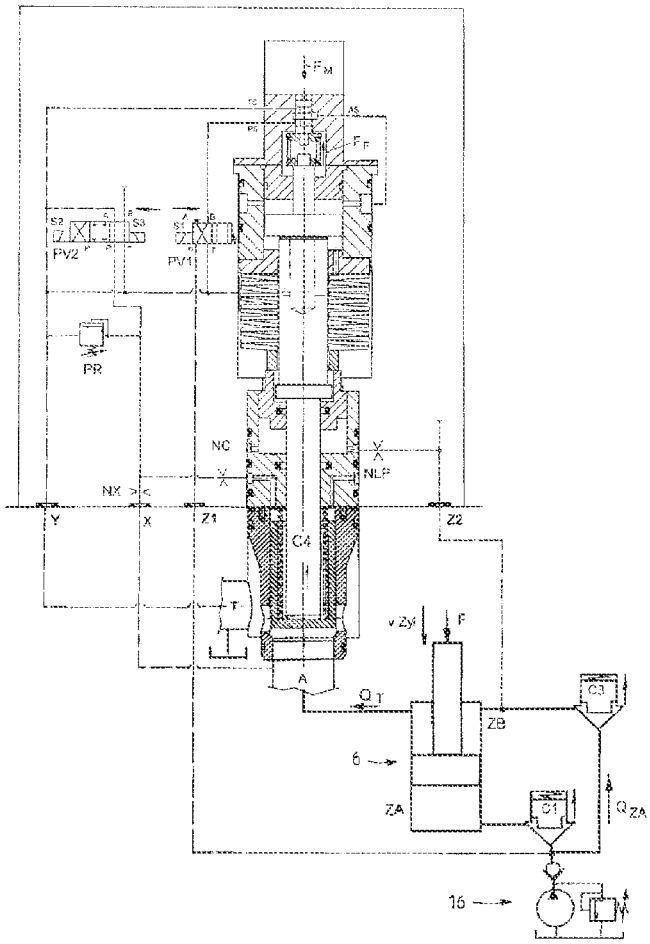
FIG. 8 shows the other tank valve unit in a working function as a throttle valve for lowering in bypass control mode (floating)
Figure 9:
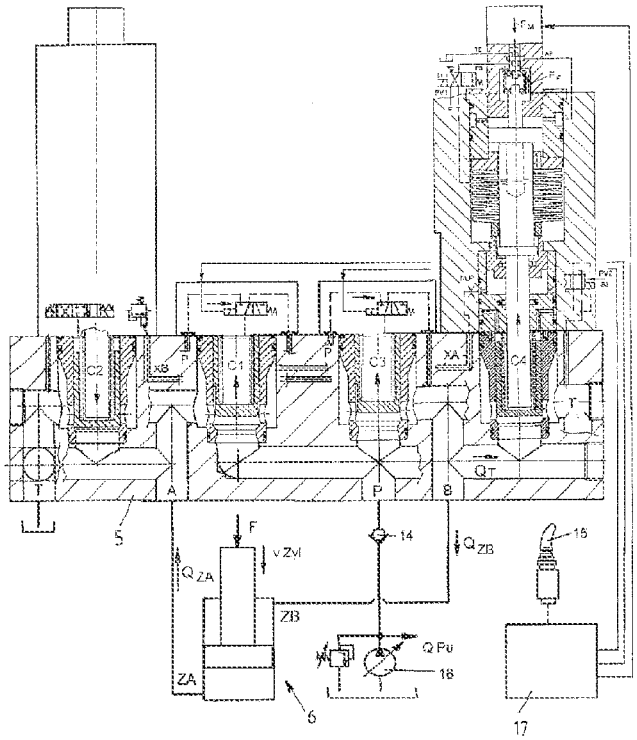
FIG. 9 schematically shows the valve block with all the valve units for activating a working cylinder during floating.

The lowering movement of the cylinders should in the normal case occur through the weight force acting on the cylinder as a negative load force in the direction of movement. By activating the pilot directional control valves PVC1 and PVC3, the two pump valve units C1 and C3 are opened, as shown in FIG. 8 and FIG. 9, with the result that the cylinder chambers ZA and ZB, hence the piston side and rod side of the cylinder 6, are hydraulically connected. If at the same time the tank valve unit C4 is opened in a throttled manner, a portion of the throughflow displaced by the piston surface flows, corresponding to the surface ratio of the cylinder 6, via the now series-arranged pump valve unit C1 and C3 to replenish the oil volume sucked away from the cylinder chamber ZB. The remaining residual flow QT displaced as surplus flows in a throttled manner via C4 to the tank or tank connection T, wherein the set throttling opening cross section of C4 determines the lowering speed of the cylinder 6. A return flow to the pump 16 is prevented by a non-return valve 14 in the pump inlet. Since the weight force after the short-circuit connection of the cylinder chambers ZA, ZB acts directly on the piston rod surface, by virtue of the resulting higher pressure through the pressurization of the lifting piston 38 via the control line XA, this piston will raise the disc spring stack 36 and completely cancel or at least to a large degree compensate for the closing force on the valve cone 28.

FIG. 9 shows the mobile valve block 5 in the function for lowering in bypass control mode (floating) with an opened pump valve unit C1, C3 for the bypass and with the tank valve unit C4 in the function as throttle valve. The proportionally controlled throttle valve function for producing the bypass control is only carried out through correspondingly adapted signal activation with the cartridge valve units C1, C3 and C4 which are present.

Figure 10:
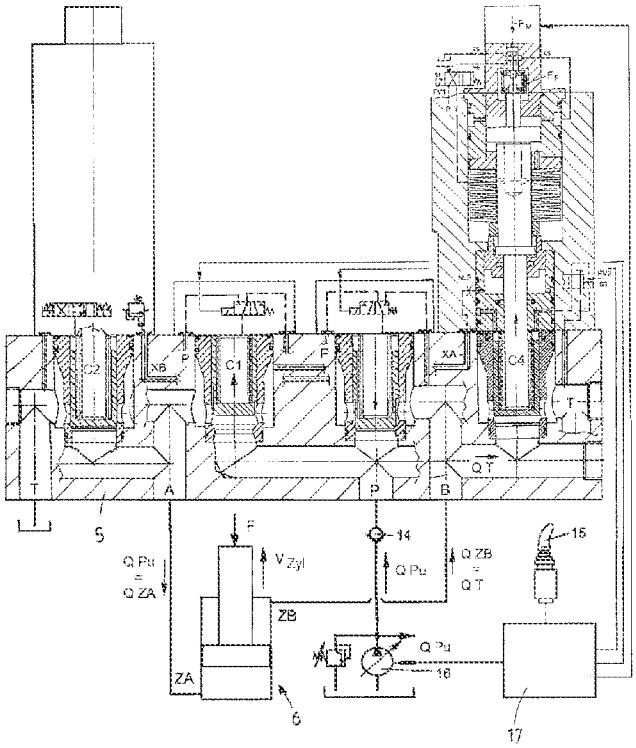
FIG. 10 schematically shows the valve block similarly to FIG. 9 in a working function as a throttle valve for a proportionally controlled outflow throttling function to limit the maximum cylinder speed.

FIG. 10 shows the mobile valve block 5 with modified electrical signal activation for a proportionally controlled outflow throttling function or limiting of the maximum cylinder speed during extension under positive force loading F. By activating the pilot directional control valve PVC1, the pump valve unit C1 is opened. As a result of the high drive pressure in the cylinder chamber ZA, the pressure returned via the control line XA again raises the lifting piston 38 and the disc spring stack 36. By switching the pilot valve PV1 via magnet S1 and by switching the pilot valve PV2 via magnet S3, the throttling function is switched on at tank valve unit C4 according to FIG. 8 or FIG. 10. This results in a mobile control with regulation of the cylinder speed with a throttle valve function.

The opening stroke of the valve cone 28 which is proportional to a predetermined electrical signal can be produced using various electrohydraulic positioning systems. For use in mobile hydraulic excavators which have to operate under harsh environmental influences, simple robust systems without electronics installed on the valve are preferred for internal return lines, and two advantageous positioning systems will now be described with reference to FIGS. 11 and 12 for an actuating piston system and to FIG. 13 for a system with a linear motor.

Figure 12:
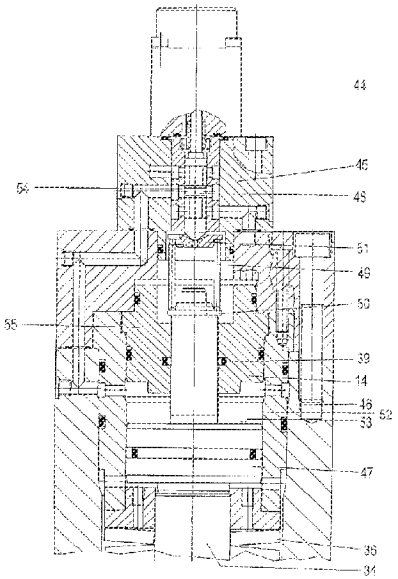
FIG. 12 shows in a sectional view the construction of the actuating system with actuating piston and proportional magnet.
Figure 5:
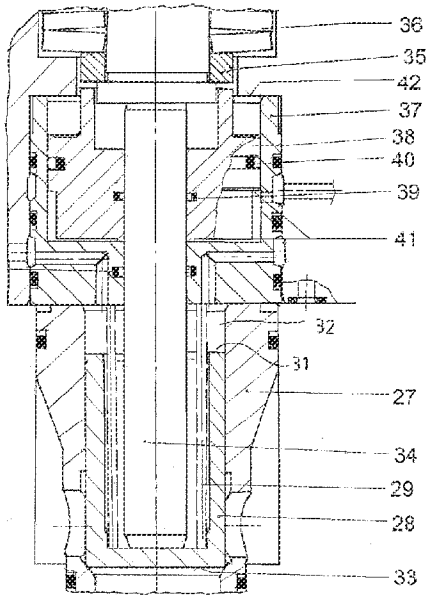
FIG. 5 shows in a detail view the valve cone with plunger actuation and lifting piston for relieving the disc spring stack in the tank valve unit according to FIG. 4.
Figure 11:
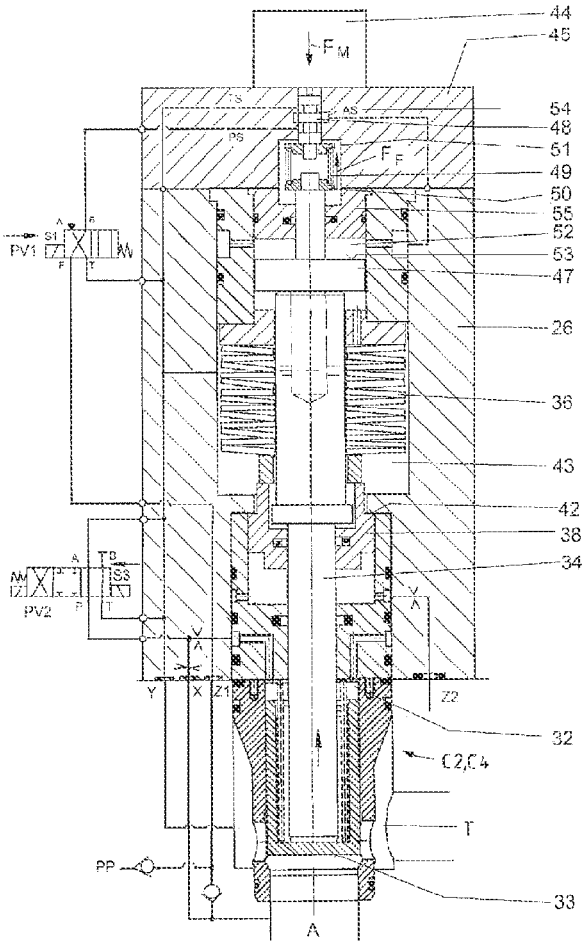
FIG. 11 schematically shows the construction of one of the tank valve units with a proportional magnet and actuating piston system for regulating the throttle valve function.

In the valve block cover 26 according to FIG. 11, a particular proportional hydraulic actuating piston system which is tailored to the existing conditions and having internal position regulation through force balancing is installed above the disc spring installation chamber 43. After actuating pilot directional control valve PV2 via magnet S3 according to FIG. 8 or FIG. 11, the control oil chamber 32 of the valve cone 28 is pressure-relieved. Consequently, all the pressure-regulating functions in the pre-control circuit are deactivated. At the same time, after actuating pilot directional control valve PV1 via magnet S1 the previously pressureless actuating piston system is pressurized through a separate control oil pressure supply PP or through pressure tapping of the highest pressure from the cylinder chambers via non-return valves (not shown). This switching state in the hydraulic pre-control circuit is represented in FIG. 8 and FIG. 11, with all the valve components not involved being omitted for better clarity. FIG. 12 separately shows the construction of the actuating piston system. The valve cone 28 pressurized on its valve seat 33 is clamped in in a force-locking manner, via the plunger 34, against the actuating piston 47 which is likewise pressurized via the actuating piston pressure surface 53 in the closing direction. Since the actuating piston pressure surface 53 is larger, in particular by about a factor of 1.2-2, than the seat surface 33 of the valve cone 28, the piston assembly formed by the actuating piston 47, plunger 34 and valve cone 28 is pressed like a differential piston in the closing position against the cartridge sleeve seat. With corresponding regulation of the pressure on the actuating piston pressure surface 53 via a control valve piston 48, this piston assembly can be displaced in the opening and closing direction. Upon activation of an associated proportional magnet 44, a magnetic actuating force is produced in the extension direction of the magnet that is proportional to the electric magnet-activating current. The magnetic actuating force actuates the control valve piston 48 against the return spring 49 in the opening direction to the tank connection. As a result of the pressure reduction which occurs on the actuating piston pressure surface 53, the opening pressure force on the seat surface 33 of the valve cone 28 predominates and the piston assembly constituted by the valve cone and actuating piston is displaced in the opening direction until the return spring 49 achieves the predetermined proportional magnetic force in force comparison terms. By resetting the control valve piston 48, the actuating piston 47 is positioned in this attained opening stroke position. In the case of this stroke regulation with spring return and force balancing in the closed regulating circuit, the opening stroke which is established at the valve cone 28 is thus proportional to the magnetic force and the electric current input signal. On reduction of the activating signal, the return spring force of the return spring 49 predominates, and therefore the control valve piston 48 opens the pressure connection and the piston assembly constituted by the valve cone and actuating piston is displaced as a result of pressure build-up in the closing direction as far as the set point position predetermined by the magnetic force.

Figure 13:
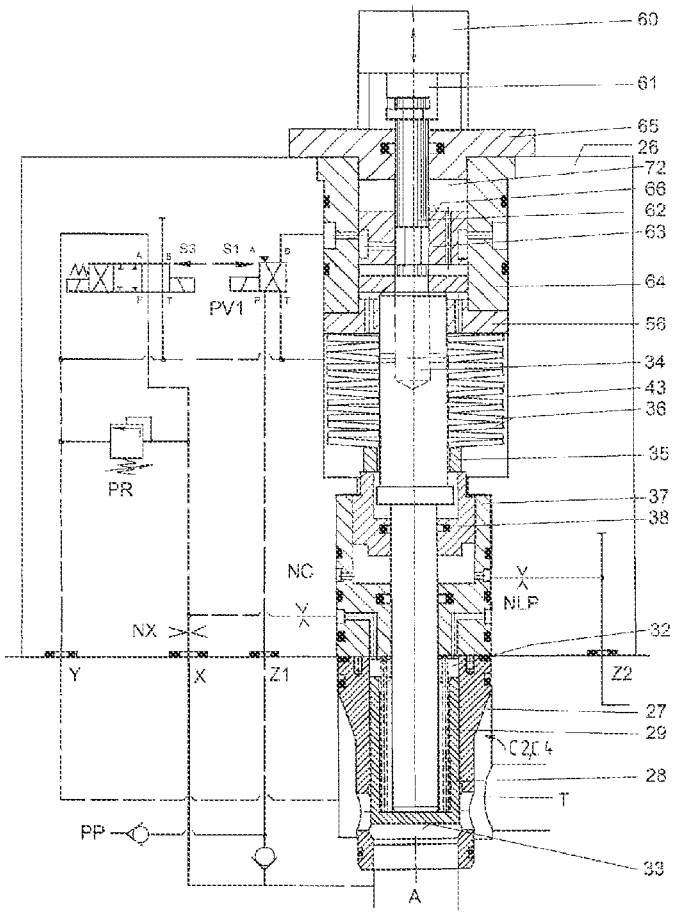
FIG. 13 schematically shows the construction of one of the tank valve units with a linear motor for regulating the throttle valve function.

Alternatively, the electric actuating signal for the proportional throttling function can be converted into a linear actuating travel by an electric stepping motor or servo motor via a threaded spindle, and a mechanical-hydraulic following piston system can hereby be activated for force amplification. The construction of this following piston system can be seen from FIG. 13. A particular servohydraulic following piston system which is tailored to the existing conditions is installed in the valve block cover 26 above the disc spring installation chamber 43. After actuating pilot directional control valve PV2 via magnet S3 according to FIG. 13, the control oil chamber 32 of the valve cone 28 is pressure-relieved and hence all the pressure regulating functions in the pre-control circuit are deactivated. At the same time, after actuating pilot directional control valve PV1 via magnet S1, the previously pressureless following piston system is pressurized by a separate control oil pressure supply PP or by pressure tapping of the highest pressure from the cylinder connections via non-return valves (not shown). This switching state in the hydraulic pre-control circuit is represented in FIG. 13, with all the valve components which are not involved being omitted for better clarity. The valve cone which is pressurized on its seat surface 33 is clamped in in a force-locking manner via the plunger 34 against the following piston 63 which is likewise pressurized in the closing direction via the following piston pressure surface 66. Since the following piston pressure surface 66 is again larger, for example by about a factor of 1.2-2, than the seat surface 33 of the valve cone 28, the piston assembly formed by following piston 63, plunger 34 and valve cone 28 is pressed like a differential piston in the closing position against the cartridge sleeve seat. With corresponding regulation of the pressure on the following piston pressure surface 66 via a control piston 62, this piston assembly can be displaced in the opening and closing direction. The control piston 62, as a three-way valve with two control edges 67, is fitted centrally in the following piston 63. From a turned groove in the following piston sleeve 64, the pressure oil flows via transverse bores into an annular channel 68 which is turned on the outer contour of the following piston 63, and therefore the pressure oil connection is established during the displacement of the following piston 63. From here, the pressure oil flows via lateral transverse bores in the following piston 63 into the turned groove 69 of the control piston 62. By displacing the control piston 62 and opening one of the two piston control edges 67 with respect to the control edge bore 70 of the following piston 63, the following piston control chamber 72 can be alternately connected to the pump connection P or the tank connection T. When displacing the control piston 62 in the opening direction, the following piston control chamber 72 is first relieved pressurelessly towards the tank. The valve cone 28 pressurized constantly via its seat surface 33 displaces the piston assembly with following piston 63 in the opening direction until the pressure control edge at the control piston 62 opens. A corresponding counterpressure builds up in the following piston control chamber 72 until a pressure force equilibrium between valve cone 28 and following piston 63 has been established. By displacing the control valve with the linear motor 60, it is possible in this following control system for the valve cone 28 to be positioned proportionally into the predetermined throttling opening with hydraulic force amplification. The control piston 62 is led outwardly from the hydraulic system while being sealed by a Glyd Ring seal in the closure cover 65 and connected there via a coupling 61 to a linear motor 60, via which the electrical position setting occurs. The positioning of the throttle valve opening can always take place proportionally to a set point value predetermined by the operating personnel via a hand lever. In the case of constantly repeating working cycles with a constant throttle opening value, this can be fixedly predetermined at the linear motor and control valve. When the pilot directional control valve PV1 is connected and pressure builds up at the following piston 63, this piston runs automatically into the position predetermined by the control piston 62.

The foregoing description will reveal to a person skilled in the art numerous modifications that are intended to come within the scope of protection of the appended claims. The figures merely show advantageous exemplary embodiments without limiting the scope of protection of the appended claims. In the case of hydraulic excavators and other hydraulic working machines, a plurality of working cylinders must usually be operated partly simultaneously and partly successively, which is why a hydraulic switching mechanism usually comprises a plurality of valve blocks having the above construction.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application.

Accordingly, it is to be distinctly understood that the foregoing descriptive matter is to be interpreted merely as illustrative of the invention and not as a limitation.

What is claimed is:

1. A hydraulic switching mechanism for the mobile hydraulics of a mobile hydraulic machine, comprising:

a valve block;

electrohydraulically activatable valve units arranged in the valve block for controlling the movement of a working cylinder, the working cylinder having two oppositely acting cylinder chambers configured to connect via first and second cylinder chamber connections to the valve block, the first and second cylinder chamber connections being selectively connectable to a pump connection for hydraulic fluid, to a tank connection, or to one another, wherein the electrohydraulically activatable valve units comprise:

a first cone-seat valve having a spring-loaded valve element and forming a pump valve unit connecting the first cylinder chamber connection and the pump connection;

a second cone-seat valve having a spring-loaded valve element and forming a tank valve unit connecting the first cylinder chamber connection and the tank connection;

a third cone-seat valve having a spring-loaded valve element and forming a second pump valve unit connecting the second cylinder chamber connection and the pump connection; and a fourth cone-seat valve having a spring-loaded valve element and forming a second tank valve unit connecting the second cylinder chamber connection and the tank connection;

wherein the spring-loaded valve element of the tank valve unit has a seat surface directly pressurized with a first pressure in the first cylinder chamber connection and a control surface indirectly pressurized with the first pressure via a pressure-limiting valve;

wherein the spring-loaded valve element of the tank valve unit is subjected to a spring force from a valve spring and a spring force of a disc spring stack in the direction of the valve seat; and a pilot valve system comprising a plurality of pilot valves configured to implement a directional control function to control a direction of the movement of the working cylinder, a lowering braking function to control a sequence of the movement of the working cylinder, and a pressure-limiting function, each via control of the first cone-seat valve, the second cone-seat valve, the third cone-seat valve, the fourth cone-seat valve, or a combination thereof, wherein the pressure-limiting function and the lowering braking function are pressure-dependent as a function of the pressure in the first and second cylinder chamber connections via control of the tank valve unit and the second tank valve unit.

2. The hydraulic switching mechanism of claim 1, wherein a throttle is arranged in a control line between the first cylinder chamber connection and the pressure-limiting valve.

3. The hydraulic switching mechanism of claim 1, wherein the spring-loaded valve element of the tank valve unit comprises a hollow socket with a cavity opposite the seat surface, the valve spring and a plunger each bear against the spring-loaded valve element by one end at a bottom of the cavity, and one end of the plunger is subjected to the spring force of the disc spring stack.

4. The hydraulic switching mechanism of claim 3, wherein a lifting piston sleeve having a lifting piston is arranged between the disc spring stack and the spring-loaded valve element of the tank valve unit, wherein a surface of the lifting piston facing away from the disc spring stack forms a lifting piston control side and is configured to be subjected to hydraulic pressure of the second cylinder chamber connection via a control line.

5. The hydraulic switching mechanism of claim 4, wherein the lifting piston is guided displaceably on the plunger and is moveable relative to the plunger in the axial direction.

6. The hydraulic switching mechanism of claim 4, wherein the lifting piston is installed in an interchangeable insert configured to be interchangeable as a structural unit after disassembly of a valve block cover and/or is replaceable by lifting pistons having different hydraulic active surfaces in order to vary a transmission ratio for the lowering braking function in order to vary a drive pressure.

7. The hydraulic switching mechanism of claim 1, wherein the pilot valve control system comprises a directly controlled pilot lowering braking valve with a valve cone slide which has an opening pressure surface configured to be subjected to the pressure of a control line connected to the first cylinder chamber connection, and a pressure activation surface configured to be subjected, via a pressure return line, to the pressure in the second cylinder chamber connection.

8. The hydraulic switching mechanism of claim 1, wherein the plurality of pilot valves is arranged in a valve housing cover releasably connected to the valve block.

9. The hydraulic switching mechanism of claim 1, wherein each of the tank valve unit and the second tank valve unit associated with an electrical stepping motor and a following piston system comprising a control piston and a following piston.

10. The hydraulic switching mechanism of claim 1, wherein, for a proportional throttling valve function of the tank valve unit and the second tank valve unit, the pump valve unit and the second PUMP valve unit are each assigned pilot directional control valves for opening each of the pump valve unit and the second pump valve unit and hydraulically connecting the first and second cylinder chamber connections or the cylinder chambers, and the tank valve unit and the second tank valve unit are each configured to be opened with an adjustable throttling opening cross section, wherein a non-return valve is arranged in a pump connection inlet.

11. The hydraulic switching mechanism of claim 10, wherein the tank valve unit is associated with having internal position regulation through force balancing.

12. The hydraulic switching mechanism of claim 11, wherein the spring-loaded valve cone of the tank valve unit comprises a hollow socket having a cavity opposite the seat surface, the valve spring and a plunger each bear against the spring-loaded valve cone of the tank valve unit by one end at the bottom of the cavity, and the other end of the plunger is configured to be subjected to the spring force of the disc spring stack, the actuating piston system is arranged in a portion adjoining an installation chamber for the disc spring stack and comprises a pressurized actuating piston which bears against the plunger with pre-stressing in the closing direction of the spring-loaded valve cone of the tank valve unit.

13. The hydraulic switching mechanism of claim 12, wherein the pressurized actuating piston has a pressure surface which is larger than a seat surface of a valve piston.

14. The hydraulic switching mechanism of claim 13, wherein the pressure surface is about 1.1 to 2.2 times larger than the seat surface.

15. The hydraulic switching mechanism of claim 12, wherein the pressurization of the pressurized actuating piston is adjustable by way of a proportional magnet, a control piston, and a return spring.

16. The hydraulic switching mechanism of claim 1, wherein a throttle is arranged in a control line between the pressure-limiting valve and a control chamber for pressurizing the control surface.

17. A hydraulic machine, comprising:

at least one hydraulic cylinder configured as a working cylinder for adjusting at least one arm connected to a working implement;

a pump unit for generating a hydraulic oil flow, the pump unit connected to a hydraulic switching mechanism comprising:

a valve block;

electrohydraulically activatable valve units arranged in the valve block for controlling the movement of the working cylinder, the electrohydraulically activatable valve units comprise:

a first cone-seat valve having a spring-loaded valve element and forming a pump valve unit connecting a first cylinder chamber connection and a pump connection;

a second cone-seat valve having a spring-loaded valve element and forming a tank valve unit connecting the first cylinder chamber connection and a tank connection;

a third cone-seat valve having a spring-loaded valve element and forming a second pump valve unit connecting a second cylinder chamber connection and the pump connection; and a fourth cone-seat valve having a spring-loaded valve element and forming a second tank valve unit connecting the second cylinder chamber connection and the tank connection; and a pilot valve system comprising a plurality of pilot valves configured to implement a directional control function to control a direction of the movement of the working cylinder, a lowering braking function to control a sequence of the movement of the working cylinder, and a pressure-limiting function, each via control of the first cone-seat valve, the second cone-seat valve, the third cone-seat valve, the fourth cone-seat valve, or a combination thereof, wherein the pressure-limiting function and the lowering braking function are pressure-dependent as a function of the pressure in the first and second cylinder chamber connections via control of the tank valve unit and the second tank valve unit, and wherein the plurality of pilot valves includes a directly controlled pilot lowering braking valve with a valve cone slide, the valve cone slide having an opening pressure surface configured to be subjected to a pressure of a control line associated with one of the first and second cylinder chamber connections, and having a pressure activation surface configured to be subjected, via a pressure return line, to a pressure in the other of the first and second cylinder chamber connections.

18. The hydraulic machine of claim 17, wherein a speed of a working movement of the working cylinder is controlled by regulating a pump delivery flow of a pump unit, wherein the pump unit comprises a variable displacement pump in which, by electrohydraulically adjusting the pivot angle, the delivery flow is controllable, or wherein the pump unit comprises a fixed displacement pump whose rotational speed is regulatable by rotational speed regulation with frequency converters.

19. The hydraulic machine of claim 18, wherein the maximum pump delivery flow rate which can be generated by the pump unit is greater than 1300 gal/min.

20. A valve unit for a hydraulic switching mechanism for mobile hydraulic machines, the valve unit comprising:

cone-seat valve units provided in a valve block for a working cylinder, the cone-seat valve units comprising:

a first cone-seat valve forming a pump valve unit connecting a first cylinder chamber connection and a pump connection;

a second cone-seat valve forming a tank valve unit connecting the first cylinder chamber connection and a tank connection;

a third cone-seat valve forming a second pump valve unit between a second cylinder chamber connection and the pump connection; and a fourth cone-seat valve forming a second tank valve unit between the second cylinder chamber connection and the tank connection;

wherein the tank valve unit and the second tank valve unit are each provided as a cartridge construction configured to be inserted into respective bores in the valve block, the cartridge construction comprising a valve sleeve, a valve element, and a valve spring, wherein the valve element comprises a hollow socket with a cavity opposite to a seat surface as a bearing surface for the valve spring and for a plunger configured to be subjected to a spring force of a disc spring stack; and a pre-control valve system comprising a plurality of pre-control valves configured to implement a pressure-limiting function and a lowering braking function, each being pressure-dependent as a function of the pressure in the first and second cylinder chamber connections via control of the tank valve unit and the second tank valve unit.

21. The valve unit of claim 20, wherein the disc spring stack and the plunger are arranged together with a lifting piston in a lifting piston sleeve, wherein the lifting piston is guided displaceably on the plunger and is moveable relative to the plunger in the axial direction, and a side of the lifting piston facing away from the disc spring stack forms a lifting piston control side.

22. The valve unit of claim 21, wherein the valve element and the lifting piston are associated with an electrohydraulic positioning system comprising at least one of an actuating piston, a proportional magnet, a linear motor, a following piston, and a control piston.

* * * * *